US008033642B2

(12) United States Patent
Shihoh et al.

(10) Patent No.: US 8,033,642 B2
(45) Date of Patent: Oct. 11, 2011

(54) INK JET RECORDING HEAD AND INK JET RECORDING APPARATUS

(75) Inventors: Makoto Shihoh, Yokohama (JP); Shoji Kanemura, Sagamihara (JP); Noriyuki Chino, Kawasaki (JP); Hiroyasu Nomura, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 12/324,438

(22) Filed: Nov. 26, 2008

(65) Prior Publication Data

US 2009/0141064 A1 Jun. 4, 2009

(30) Foreign Application Priority Data

Nov. 30, 2007 (JP) ..... 2007-309699
Oct. 31, 2008 (JP) ..... 2008-281870

(51) Int. Cl.
*B41J 2/155* (2006.01)

(52) U.S. Cl. ..... 347/42

(58) Field of Classification Search ..... 347/40–43
See application file for complete search history.

(56) References Cited

U.S. PATENT DOCUMENTS 6,074,035 A 6/2000 Irizawa

FOREIGN PATENT DOCUMENTS

JP 08-150711 6/1996

*Primary Examiner* — An Do
(74) *Attorney, Agent, or Firm* — Canon USA Inc IP Division

(57) ABSTRACT

An ink jet recording head includes a flow passage for a liquid for cooling a recording element substrate. The flow passage is provided inside a support plate that supports the recording element substrate along a recording element array of the recording element substrate. The shortest distance between a recording element and the flow passage at the end of the support plate is larger than the shortest distance between a recording element and the flow passage in the middle of the support plate.

14 Claims, 18 Drawing Sheets

INK JET RECORDING HEAD AND INK JET RECORDING APPARATUS

BACKGROUND OF THE INVENTION

1. Field of the Invention

The present invention relates to an ink jet recording apparatus that discharges ink, thereby performing a recording operation, and an ink jet recording head used in such a recording apparatus.

2. Description of the Related Art

Ink jet recording apparatuses can record color images at low operational cost and can be reduced in size, and therefore have been widely used, for example, in computing output devices and commercialized.

In recent years, in order to realize higher-speed and more detailed image recording, the realization of a recording head having a longer recording width (discharge port array length) has been hoped for. Specifically, a recording head having a length of 4 to 13 inches has been demanded.

The longer and higher-speed a recording head is, the larger the energy input into the recording head is, and the more significantly the temperature of the recording head during recording increases. This causes, for example, fluctuation in discharge amount per page, unstable discharge at high temperature, and deterioration in ability of continuous recording. Therefore, measures to maintain the recording reliability need to be taken.

Japanese Patent Laid-Open No. 8-150711 and U.S. Pat. No. 6,074,035 describe, for example, air-cooling from outside a recording head, and attaching a cooling tube to a recording head.

However, conventional ink jet recording heads have a problem such as that shown in FIG. 18. FIG. 18 shows the temperature distribution of a recording head having a coolant flow passage for circulating coolant provided along the discharge port array thereof just after the execution of recording. The horizontal axis shows the position in the direction of the array of recording elements (for example, heaters serving as electro-thermal transducers) of the recording head. The vertical axis shows the temperature in the vicinity of a recording element. It is proved by experiment that, in the vicinity of the end of an ink jet recording head, the temperature decreases toward the end.

It is also proved that, with the increase in the temperature in the vicinity of a recording element of an ink jet recording head, the amount of ink discharged increases. For example, the amount of ink discharged increases by 0.5 to 1.0 percent per degree rise in temperature.

Therefore, if the temperature of the end of a recording head is lower than that of the middle thereof, the amount of ink discharged from a discharge port at the end of the recording head is smaller than the amount of ink discharged from a discharge port in the middle of the recording head. As a result, when it is tried to form an image of uniform density on a recording medium, the density of the end of the resulting image is lower than the density of the middle of the image.

The recording head described in U.S. Pat. No. 6,074,035 eliminates the above-described temperature distribution by "providing a print head with a flow passage so that a liquid flows in the direction in which a distribution of temperature can occur, changing the cross-sectional area of the flow passage according to the temperature distribution that can occur in the liquid flowing through the flow passage, and thereby producing a distribution of flow rate." For example, the cross-sectional area of the flow passage is largest on the most upstream side, decreases downstream, and is smallest and constant in the middle portion and the portion downstream thereof. By such a configuration, the above-described temperature distribution can be eliminated.

However, in order to eliminate the temperature distribution by this method, the cross-sectional area of the most upstream portion needs to be rather large, and this causes the recording head to be large.

SUMMARY OF THE INVENTION

The present invention is directed to an ink jet recording head that can reduce the difference between the temperature in the vicinity of a recording element at the end in the longitudinal direction of the recording head and the temperature in the vicinity of a recording element in the middle in the longitudinal direction of the recording head.

In an aspect of the present invention, an ink jet recording head includes a recording element substrate and a support plate configured to support the recording element substrate. The recording element substrate has a recording element array having a plurality of recording elements configured to generate thermal energy for discharging ink. The support plate has a flow passage facilitating flow of a liquid for cooling the recording element substrate. The flow passage is disposed along an arranging direction of the plurality of recording elements. The shortest distance between one of the plurality of recording elements disposed at the end of the support plate in the arranging direction and the flow passage is larger than the shortest distance between one of the plurality of recording elements disposed in the middle of the support plate in the arranging direction and the flow passage.

Such a configuration reduces the difference between the temperature in the vicinity of a recording element at the end in the longitudinal direction of the recording head and the temperature in the vicinity of a recording element in the middle in the longitudinal direction of the recording head. Therefore, it is possible to provide a recording head that can reduce the adverse effects of the difference in temperature between the end and the middle of the recording head, on the discharge.

Further features of the present invention will become apparent from the following description of exemplary embodiments with reference to the attached drawings.

DESCRIPTION OF THE EMBODIMENTS

The embodiments of the present invention will now be described with reference to the drawings.

First Embodiment

FIGS. 1 to 9 illustrate an ink jet recording head and an ink jet recording apparatus by which the present invention is carried out or to which the present invention is applied. With reference to these figures, the structure of each component and the entire structure will be described.

Figure 1:
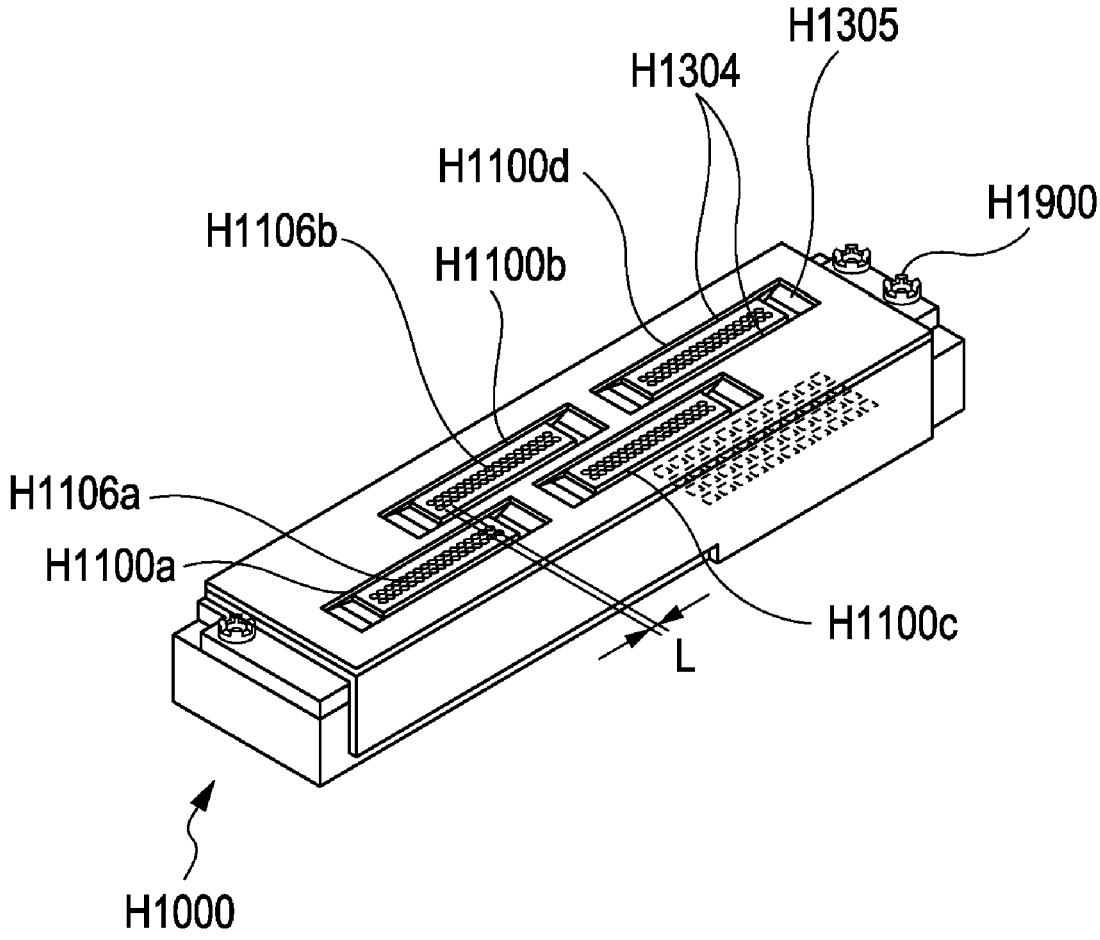
FIG. 1 is a perspective view of an ink jet recording head according to an embodiment of the present invention.

The ink jet recording head H1000 shown in FIG. 1 is of a type that performs recording using, as recording elements, electro-thermal transducers (electro-thermal transducer elements H1102) that generate thermal energy in response to an electric signal. As shown in the exploded perspective view of FIG. 2, the ink jet recording head H1000 is composed of a recording element unit H1001 and an ink supply member H1500 of an ink supply unit H1002. As shown in the exploded perspective view of FIG. 3, the recording element unit H1001 is composed of recording element substrates H1100, a support plate H1200, an electric wiring member H1300, a plate H1400, and filter members H1600.

Figure 3:
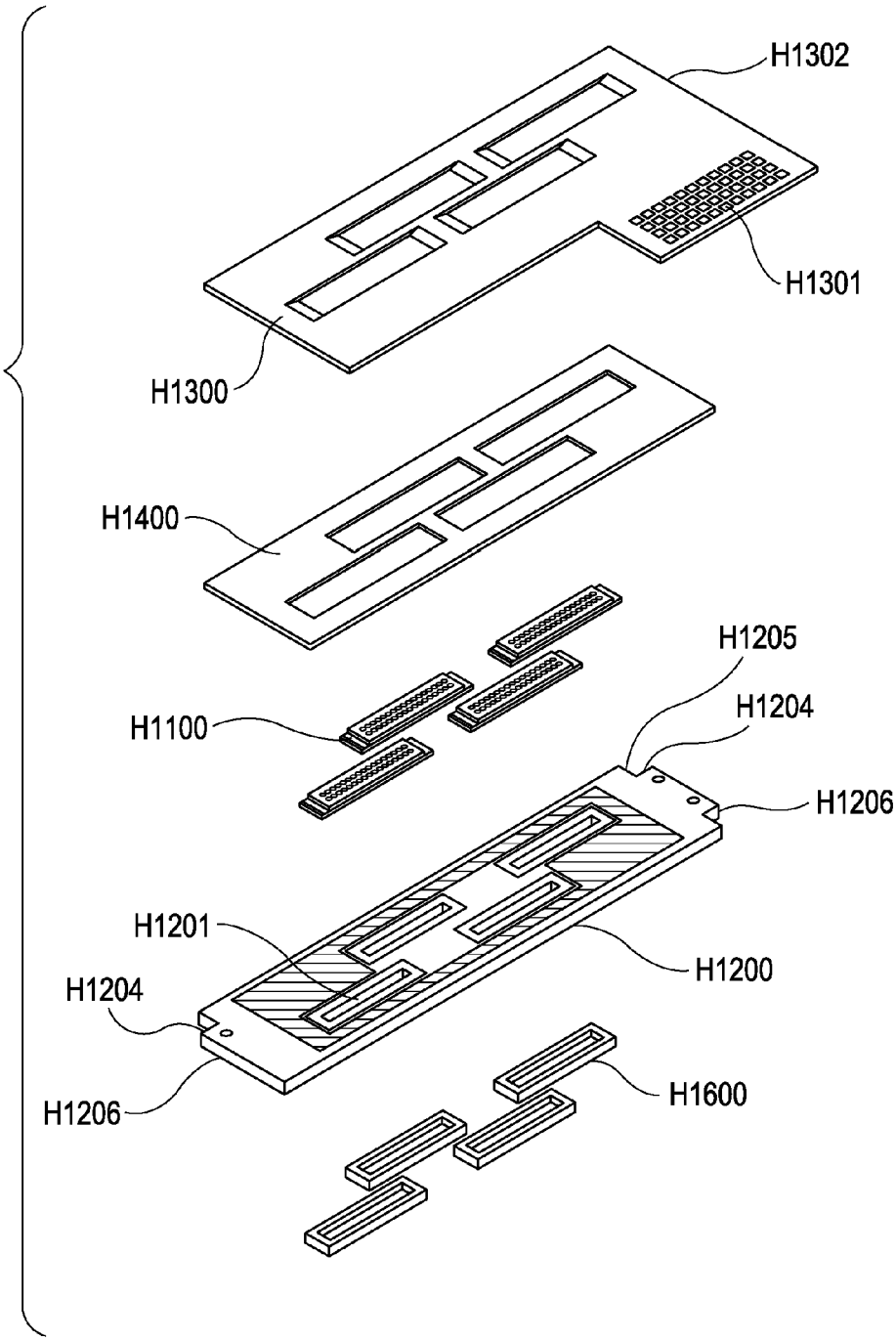
FIG. 3 is an exploded perspective view of a recording element unit.
Figure 4A:
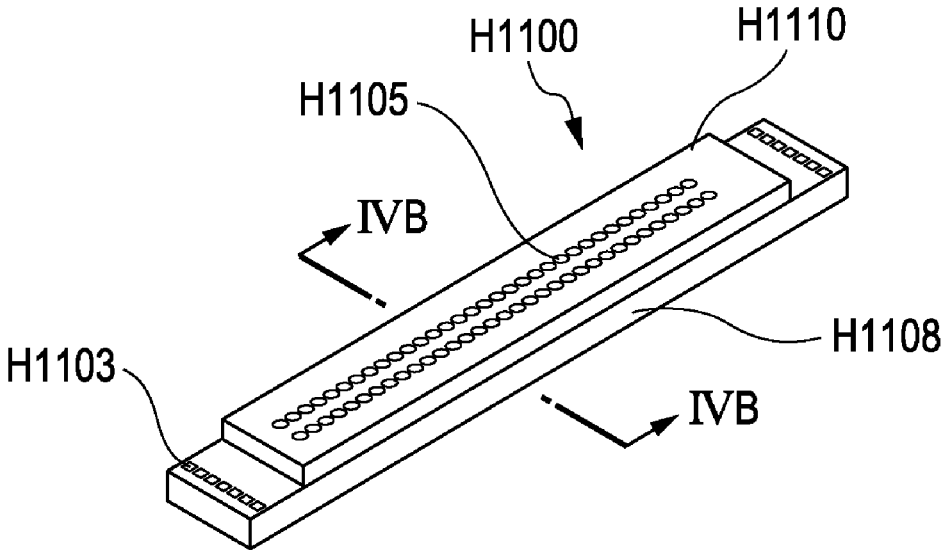
FIG. 4A is a perspective view of a recording element substrate according to a first embodiment.
Figure 4B:
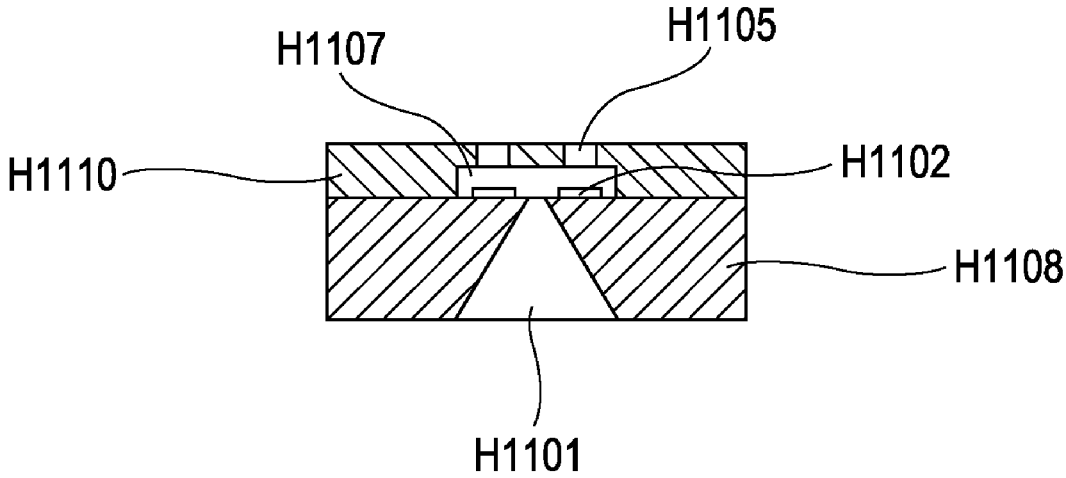
FIG. 4B is a sectional view taken along line IVB-IVB of FIG. 4A.

FIG. 4A illustrates the structure of a recording element substrate H1100. FIG. 4B is a sectional view taken along line IVB-IVB of FIG. 4A. The recording element substrate H1100 is formed, for example, of a silicon substrate H1108 0.5 to 1 mm thick. An ink supply port H1101, which is a rectangular through opening, is formed therein as an ink flow passage. Astride the ink supply port H1101, electro-thermal transducer elements H1102 serving as recording elements are arranged in a staggered manner. That is, along the longitudinal direction of the ink supply port H1101, which is rectangular, and on each side thereof is formed an array of electro-thermal transducer elements H1102 serving as recording elements. As shown in FIG. 3, a plurality of recording element substrates H1100 are disposed in the support plate so that an array of electro-thermal transducer elements serving as recording elements continues along the longitudinal direction of the recording head. The electro-thermal transducer elements H1102 and electric wiring, for example, of aluminum are formed by a deposition technique. Electrodes H1103 for supplying power to the electric wiring are provided.

By performing anisotropic etching using the crystal orientation of the silicon substrate H1108, an opening having an angle of about 54.7 degrees is formed. Using this method, etching is performed to a desired depth to form the ink supply port H1101.

On the top of the silicon substrate H1108 is provided a flow passage forming member H1110, in which ink flow passages H1104, discharge ports H1105, and bubble generating chambers H1107 corresponding to the electro-thermal transducer elements H1102 are formed by a photolithographic technique. The discharge ports H1105 are provided so as to face the electro-thermal transducer elements H1102. In the ink supplied from the ink supply port H1101, air bubbles are generated by the electro-thermal transducer elements H1102 to discharge the ink.

The support plate H1200 is formed, for example, of an alumina ($Al_2O_3$) material 0.5 to 10 mm thick. The material of the support plate H1200 is not limited to alumina. The support plate H1200 may be formed of a material having a linear expansivity equal to the linear expansivity of the material of the recording element substrates H1100 and a thermal conductivity equal to or higher than the thermal conductivity of the material of the recording element substrates H1100. Materials of the support plate H1200 include silicon (Si), aluminum nitride (AlN), zirconia, silicon nitride ($Si_3N_4$), silicon carbide (SiC), molybdenum (Mo), and tungsten (W).

The support plate H1200 has ink supply ports H1201 for supplying ink to the recording element substrates H1100. The ink supply ports H1101 of the recording element substrates H1100 correspond to the ink supply ports H1201 of the support plate H1200. The recording element substrates H1100 are bonded to the support plate H1200 with a high degree of positioning accuracy. The support plate H1200 has X direction references H1204, Y direction references H1205, and Z direction references H1206 serving as positioning references.

As shown in FIG. 1, the recording element substrates H1100 are disposed in a staggered manner on the top of the support plate H1200 and discharge the same color of ink, thereby enabling a wide recording in the same color. For example, four recording element substrates H1100*a*, H1100*b*, H1100*c*, and H1100*d* each having a discharge port array at least one inch in length are disposed in a staggered manner, thereby enabling a four-inch wide recording.

As shown in FIG. 1, the discharge port arrays of the recording element substrates, which are disposed in a staggered manner, overlap along the arranging direction of the discharge ports so that a discharge port array continues throughout the recording head. For example, the discharge port arrays H1106*a* and H1106*b* have an overlapping region L.

The electric wiring member H1300 is for applying an electric signal for discharging ink to the recording element substrates H1100, and has openings into which the recording element substrates H1100 are fitted. The plate H1400 is bonded to the underside of the electric wiring member H1300. The electric wiring member H1300 has electrode terminals H1302 corresponding to the electrodes H1103 of the recording element substrates H1100, and an external signal input terminal H1301 located at the end of the wiring member and receiving an electric signal from the recording apparatus main body. The electric wiring member H1300 and the recording element substrates H1100 are electrically connected. For example, the electrodes H1103 of the recording element substrates H1100 and the electrode terminals H1302 of the electric wiring member H1300 are electrically connected by a wire bonding technique using gold wires (not shown). The electric wiring member H1300 is formed, for example, of a two-layered flexible wiring substrate. The surface layer thereof is covered with a polyimide film.

The plate H1400 is formed, for example, of a stainless steel plate 0.5 to 1 mm thick. The material of the plate is not limited to stainless steel. The plate may be formed of a material having a resistance to ink and an excellent flatness. The plate H1400 has openings into which the recording element substrates H1100 bonded to the support plate H1200 are fitted, and is bonded to the support plate H1200.

The gap between the side edge of each opening H1402 of the plate and the side edge of the recording element substrate H1100 disposed therein is filled with a first sealant H1304. The electric mounting portion of the electric wiring member H1300 is thereby sealed. The electrodes H1103 of the recording element substrates are sealed with a second sealant H1305. The electric connecting portions are thereby protected from ink erosion and external impact.

To the ink supply ports H1201 on the underside of the support plate H1200 are bonded filter members H1600 for removing foreign substances in ink.

The ink supply member H1500 is formed, for example, by resin molding, and has a common liquid chamber H1501 and Z direction reference surfaces H1502. The Z direction reference surfaces H1502 are for positioning and fixing the recording element unit and serve as Z references of the recording head H1000.

Figure 2:
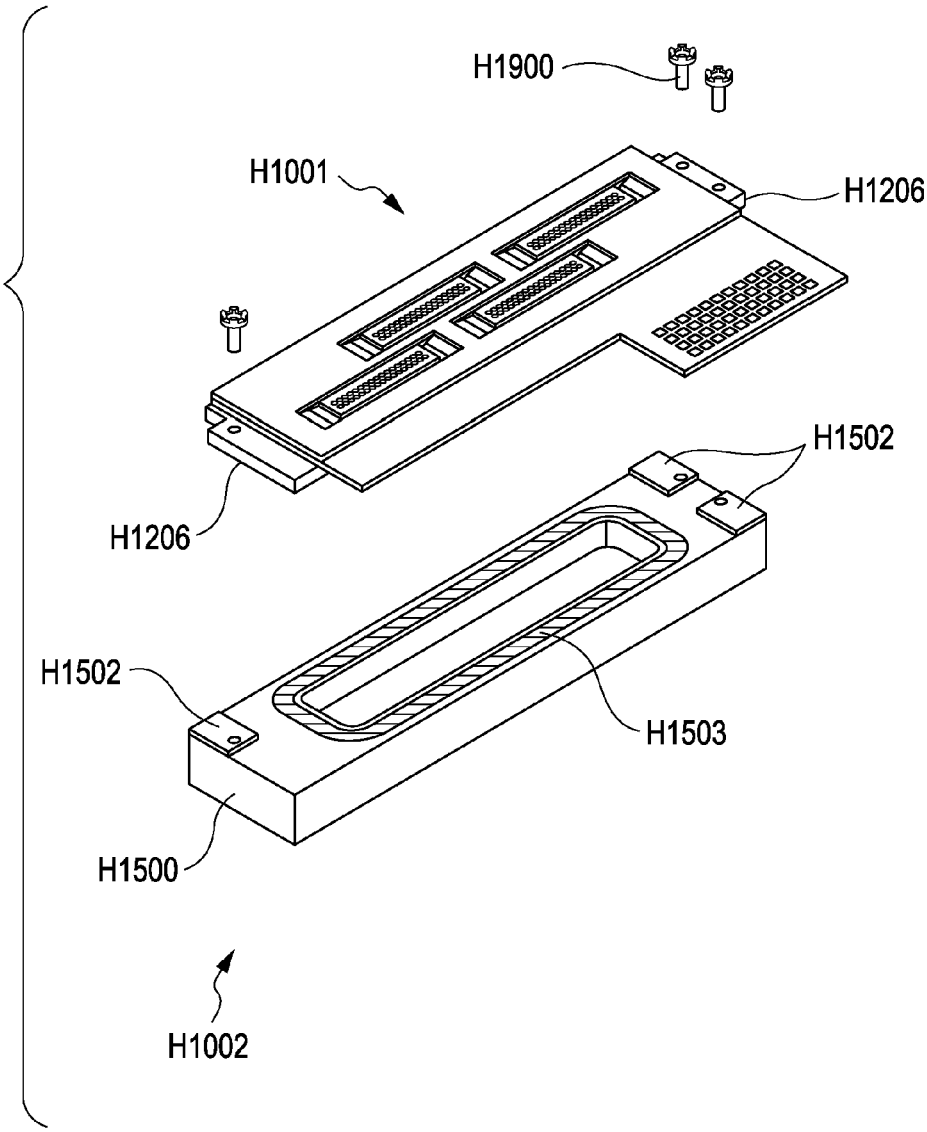
FIG. 2 is an exploded perspective view of an ink jet recording head according to an embodiment of the present invention.

As shown in FIG. 2, the ink jet recording head H1000 is completed by joining the recording element unit H1001 to the ink supply member H1500.

The joining is performed as follows.

The space between the edge of the opening of the ink supply member H1500 and the recording element unit H1001 is sealed with a third sealant H1503. The common liquid chamber H1501 is thereby sealed. To the Z references H1502 of the ink supply member H1500, the Z references H1206 of the recording element unit H1001 are positioned and fixed, for example, with screws H1900. The external signal input terminal H1301 of the recording element unit H1001 is positioned and fixed, for example, to the underside of the ink supply member H1500.

Figure 5:
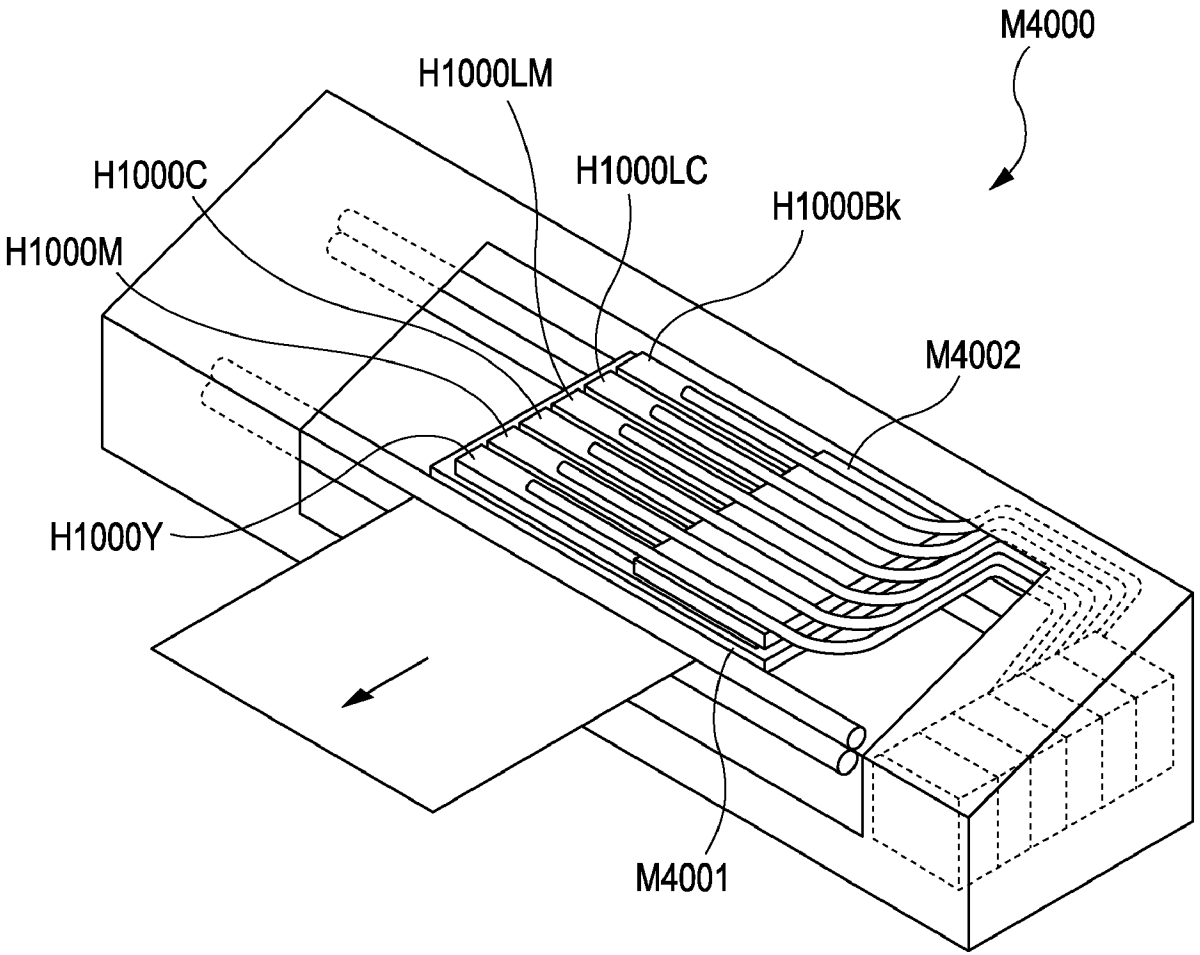
FIG. 5 illustrates an ink jet recording apparatus (full-line type).

As shown in FIG. 5, the ink jet recording apparatus M4000 having ink jet recording heads according to any one of the embodiments of the present invention has, for example, recording heads for six colors for recording of photographic quality. The recording head H1000Bk is a recording head for black ink. The recording head H1000C is a recording head for cyan ink. The recording head H1000M is a recording head for magenta ink. The recording head H1000Y is a recording head for yellow ink. The recording head H1000LC is a recording head for light cyan ink. The recording head H1000LM is a recording head for light magenta ink. These ink jet recording heads H1000 are fixed and supported by positioning units and electric contacts M4002 of a head mounting portion M4001 mounted in the main body of the recording apparatus M4000.

These recording heads are controlled by a drive circuit (not shown) and recording is performed on a recording medium. The recording apparatus of FIG. 5 is of a full-line type, in which the length of the discharge port array of each ink jet recording head is equal to the width of the recording medium, the ink jet recording heads are stationary, and a recording medium is moved in the direction of the arrow to perform recording.

Figure 6:
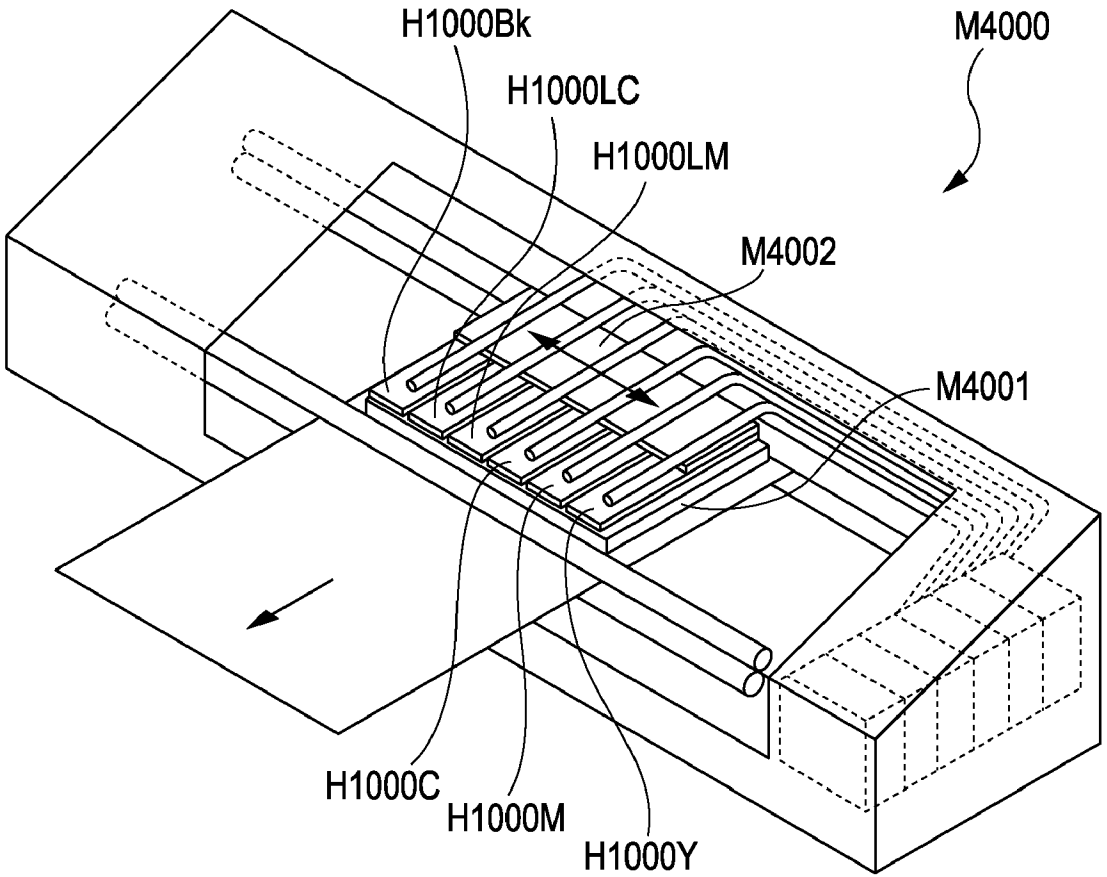
FIG. 6 illustrates an ink jet recording apparatus (serial drive type).

The recording apparatus of FIG. 6 is of a serial drive type, in which ink jet recording heads are mounted on a carriage serving as a head mounting portion M4001 and are moved in the main scanning direction (the direction in which the carriage moves) to perform recording.

Figure 17:
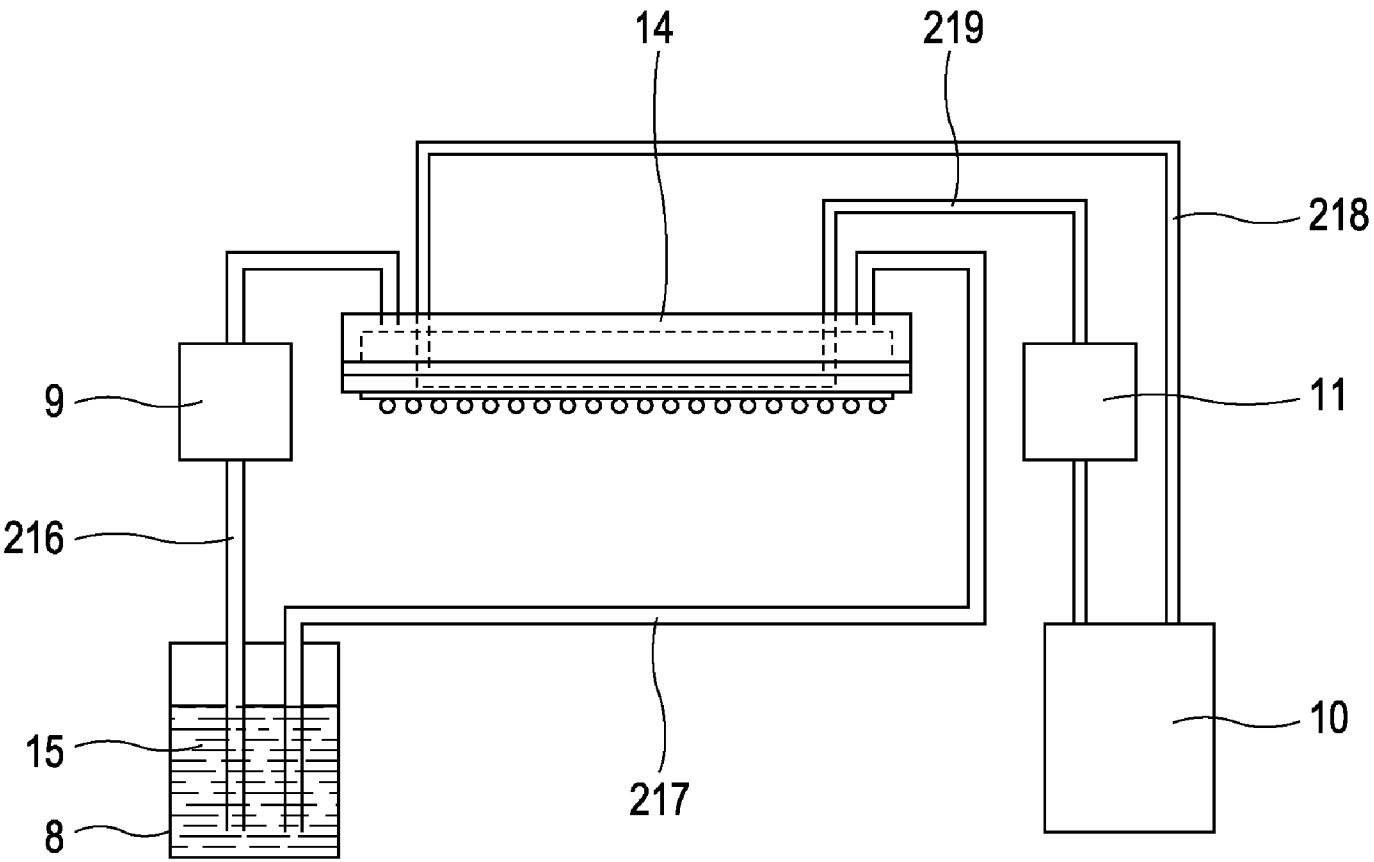
FIG. 17 is a schematic view showing an ink and coolant supply system of an ink jet recording apparatus.
Figure 18:
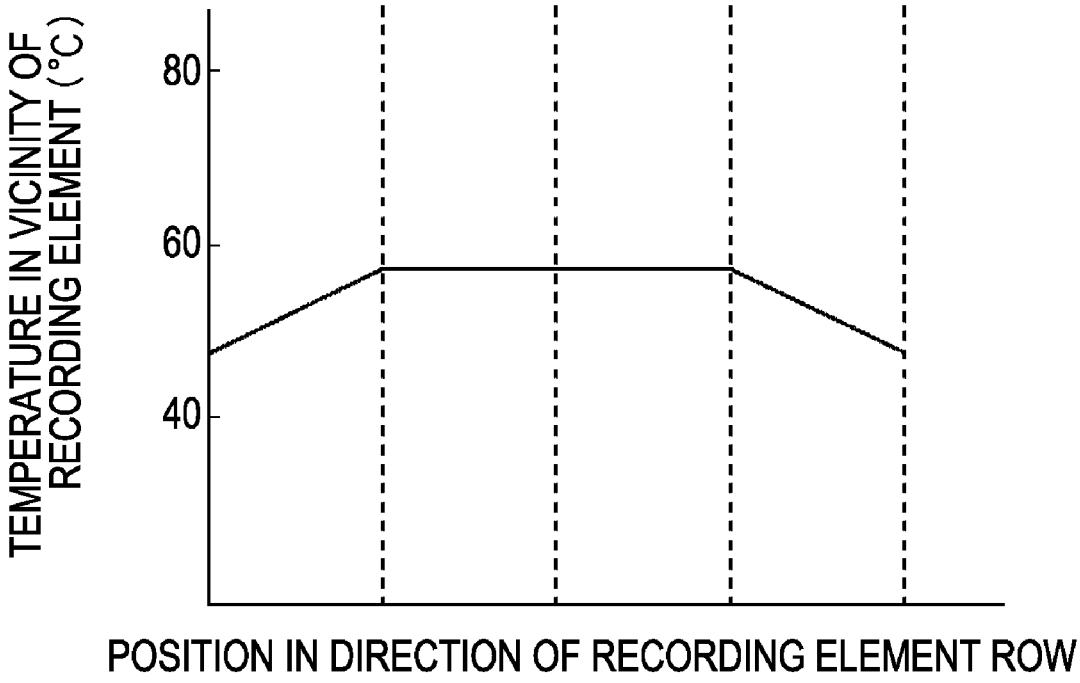
FIG. 18 illustrates the temperature distribution of a conventional ink jet recording head just after the execution of recording.

FIG. 17 is a schematic view showing an ink and coolant supply system of an ink jet recording apparatus.

As shown in FIG. 17, the supply system has an ink tank 8 storing ink 15. In the ink tank 8 are disposed two tubes 216 and 217. One 217 of the tubes is connected to one end of a recording head 14 and is communicated with a common liquid chamber of the recording head 14. The other tube 216 is connected via a pump 9 to the other end of the recording head 14 and is communicated with the common liquid chamber of the recording head 14.

The ink jet recording head 14 has a plurality of ink discharge port arrays. If air bubbles exist in the ink flow passages, the air bubbles can be discharged out of the ink tank 8 by driving the pump 9 and circulating ink. At the time of ink discharge from the ink jet recording head 14, for example, at the time of recording, ink is supplied from the ink tank 8 via the tube 217 or 216 to the ink jet recording head 14 by capillary force.

Reference numeral 10 denotes a coolant tank. In the coolant tank 10 are disposed two tubes 218 and 219. One 218 of the tubes is connected to one end of the recording head 14 and is communicated with a coolant flow passage in a support plate H1200 of the ink jet recording head 14. The other tube 219 is connected via a pump 11 to the other end of the ink jet recording head 14 and is communicated with the coolant flow passage in the support plate H1200 of the ink jet recording head 14. When the temperature of the ink jet recording head 14 increases, the pump 11 is driven, and the coolant in the coolant tank 10 circulates through the tube 218, the support plate H1200, and the tube 219 in this order, thereby cooling the ink jet recording head 14.

In addition, this coolant supply system has a control unit (not shown), which circulates coolant through the coolant flow passage in the ink jet recording head, thereby preventing the temperature of the ink jet recording head from increasing. This control unit sets cooling conditions based on detected data such as the flow rate of coolant, the inlet temperature, the outlet temperature, the head temperature (measured, for example, by a sensor built into a recording element substrate), and the environmental temperature, the amount of heat removed from the head by the coolant, and various conditions such as recording conditions, and controls the head temperature. In addition, the control unit can independently control at least one of the flow direction, the fluid temperature, and the flow velocity of coolant. A fine-tuned control based on the difference in recording duty among a plurality of recording element substrates.

Figure 7A:
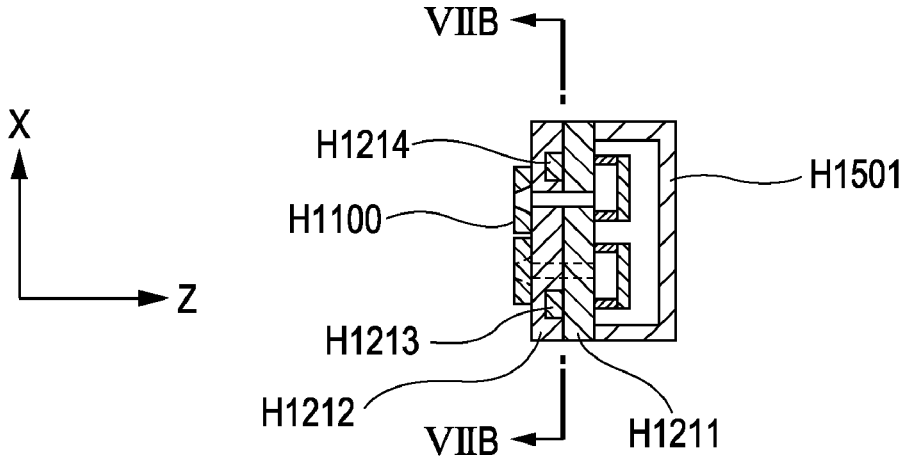
FIG. 7A schematically shows a cross section in the XZ plane of an ink jet recording head of a first embodiment.
Figure 7B:
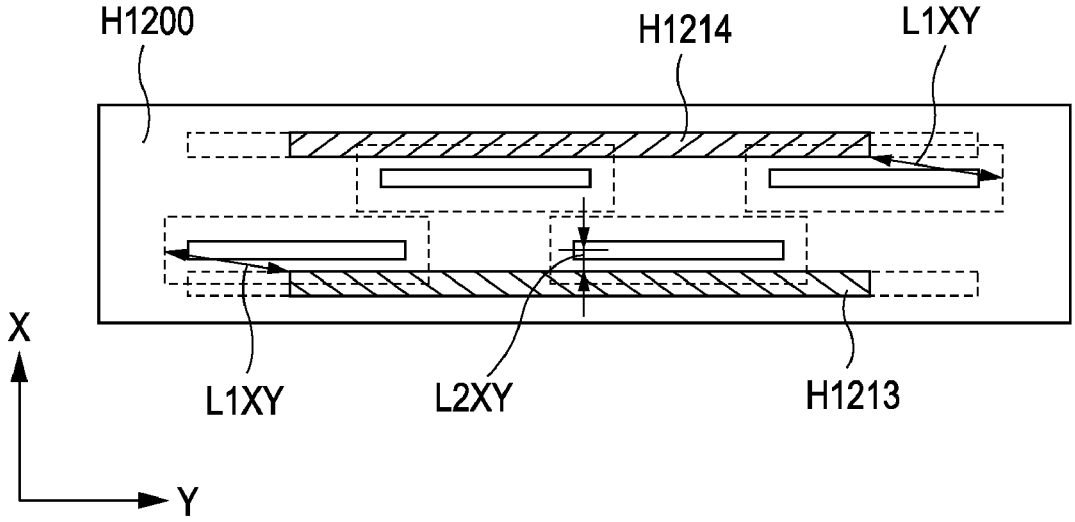
FIG. 7B schematically shows a cross section in the XY plane of an ink jet recording head of a first embodiment.

FIGS. 7A and 7B schematically show partial sections of an ink jet recording head according to an embodiment of the present invention. FIG. 7B is a sectional view taken along line VIIB-VIIB of FIG. 7A. A support plate H1200 is composed of two members H1211 and H1212. By providing grooves in which coolant flows in the member H1212 and bonding the two members H1211 and H1212 together, cooling flow passages (coolant flow passages) H1213 and H1214 are formed. That is, flow passages of liquid for cooling the recording element substrates H1100 are provided inside the support plate H1200 along the arrays of recording elements H1102 of the recording element substrates H1100. The inlet and outlet (not shown) of coolant are located on the opposite side of the ink supply member H1500 from the recording element substrates H1100. The flow passages H1213 and H1214 are formed so as to be able to independently circulate coolant. The coolant flow passages H1213 and H1214 have a constant cross section that is 2 mm wide and 1.5 mm deep in this embodiment. The flow rate of coolant is about 20 ml/min to 300 ml/min. A flow rate that meets conditions is set based on the recording conditions and the head specification (the electric power, the amount of discharge, and so forth). A common ink chamber H1501 is provided on the opposite side of the support plate H1200 from the recording element substrates H1100. Through each ink supply port provided in the support plate H1200, ink is supplied to the recording element substrates H1100.

In the case of a plurality of coolant flow passages, the temperatures of the ink jet recording heads can be finely controlled by changing the flow direction of coolant and/or the number of passages used.

Figure 8:
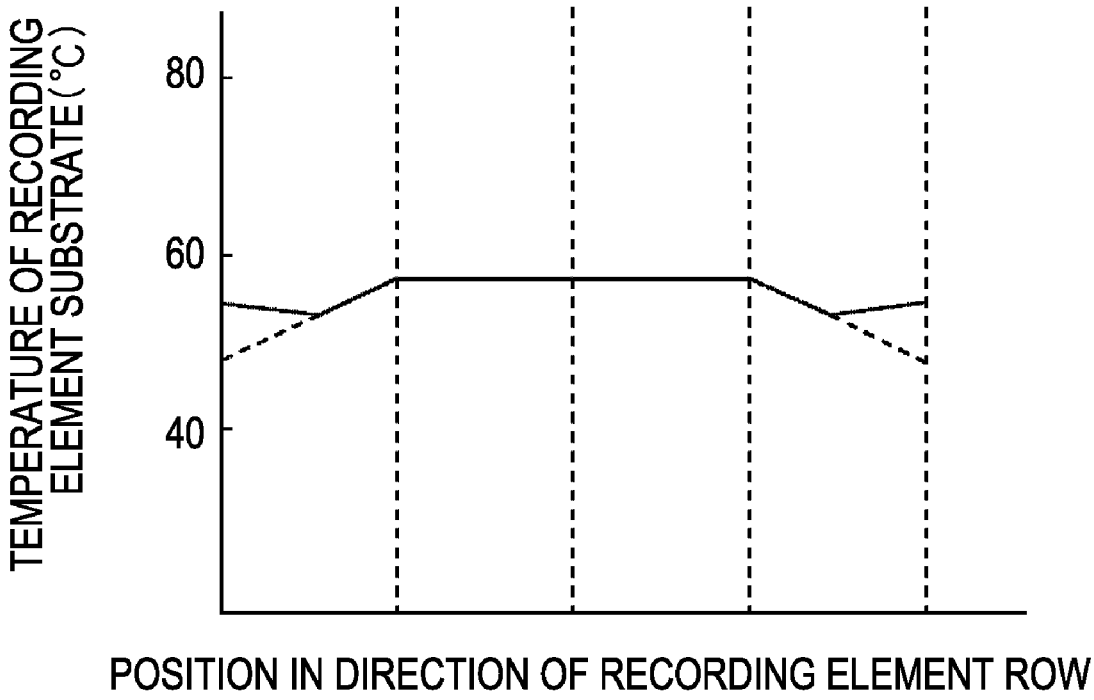
FIG. 8 illustrates the temperature distribution of an ink jet recording head just after the execution of recording.

FIG. 8 shows the temperature distribution of an ink jet recording head just after the execution of recording. The horizontal axis shows the position in the direction of the array of recording elements (for example, heaters serving as electro-thermal transducers) of the recording head. The vertical axis shows the temperature in the vicinity of a discharge port. The solid line portion in the graph shows the temperature distribution in the case where the coolant flow passages are shortened as shaded in FIG. 7B. The dashed line portion in FIG. 8 shows the temperature distribution in the case where, in the recording head of FIG. 7B, the coolant flow passages are lengthened to the dashed line portions nearly equal to the maximum recording region width (that is, the recording element array length or the discharge port array length). The part of the dashed line portion other than both ends corresponds to that of the solid line portion and is therefore omitted.

In this embodiment, the shortest distance L1XY between an electro-thermal transducer element and the nearer coolant flow passage in the XY plane at the end of the support plate along the Y direction is larger than the shortest distance L2XY in the XY plane in the middle of the support plate along the Y direction. In this embodiment, the distance between each electro-thermal transducer and the nearer coolant flow passage differs along a plane parallel to the main surface of the support plate (XY plane). The shortest distance L1Z (not shown) between an electro-thermal transducer element and the nearer coolant flow passage at the end of the support plate in the Z direction is substantially the same as the shortest distance L2Z (not shown) between an electro-thermal transducer element and the nearer coolant flow passage in the middle of the support plate in the Z direction. Therefore, if L1XY>L2XY, a relationship L1>L2 is satisfied, where L1 is the shortest distance between an electro-thermal transducer element and the nearer coolant flow passage in the XYZ space at the end of the support plate, and L2 is the shortest distance between an electro-thermal transducer element and the nearer coolant flow passage in the XYZ space in the middle of the support plate.

The above-described configuration prevents both ends of the recording head from being excessively cooled, reduces the difference in temperature between the both ends of the recording head and the middle of the recording head, and can substantially even out the temperature of the recording head throughout the length thereof.

It is considered that each electro-thermal transducer element in each recording element substrate is located in the center of the recording element substrate in the X direction in FIG. 7B. The reason is that it can be considered that the heat generation of each electro-thermal transducer element occurs in the center of the recording element substrate in the X direction. Therefore, L1XY denotes the distance between the center in the X direction of the end of a recording element substrate near the end of the support plate and the coolant flow passage near the end of the support plate. L2XY denotes the distance, in the middle of the support plate in the Y direction, between the center in the X direction of a recording element substrate near a coolant flow passage and the coolant flow passage.

The shortest distance L1XY between an electro-thermal transducer element at the end of the support plate and the nearer coolant flow passage depends on parameters such as the maximum heating value of the recording element substrates H1100, the distance between each electro-thermal transducer element array and the nearer coolant flow passage, the thermal conductivity of the support plate H2100, and the flow rate of coolant.

Figure 9:
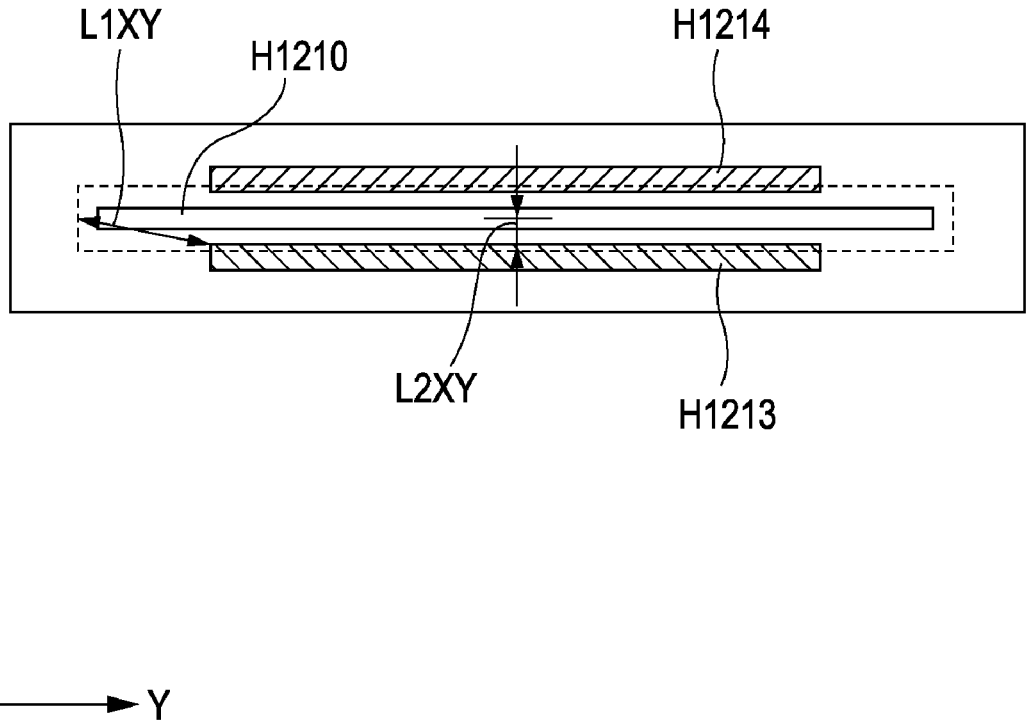
FIG. 9 schematically shows a cross section in the XY plane corresponding to FIG. 7B, of an ink jet recording head using a single elongate recording element substrate.

Although an ink jet recording head in which a plurality of recording element substrates H1100 are arranged in a staggered manner is described above, the present invention can also be applied to an ink jet recording head using a single elongate recording element substrate H1210 as shown in FIG. 9. FIG. 9 schematically shows a partial section corresponding to FIG. 7B of an ink jet recording head using a single elongate recording element substrate H1210.

Although this embodiment has two coolant flow passages H1213 and H1214, the number of coolant flow passages is not limited to this. Although the coolant flow passages H1213 and H1214 continue throughout the length of the recording head, each of them may be divided in the longitudinal direction.

In the case of two coolant flow passages such as that shown in FIG. 7, the flow directions of coolant of the coolant flow passages H1213 and H1214 are preferably opposite to each other. The temperature of coolant in each coolant flow passage on the downstream side is higher than that on the upstream side, and therefore a temperature gradient occurs in the coolant in each coolant flow passage along the Y direction. Therefore, when the flow directions are as described above, the temperature gradients on both sides of the support plate are opposite to each other in the Y direction, and thereby the cooling effect can be evened out.

Second Embodiment

Figure 10A:
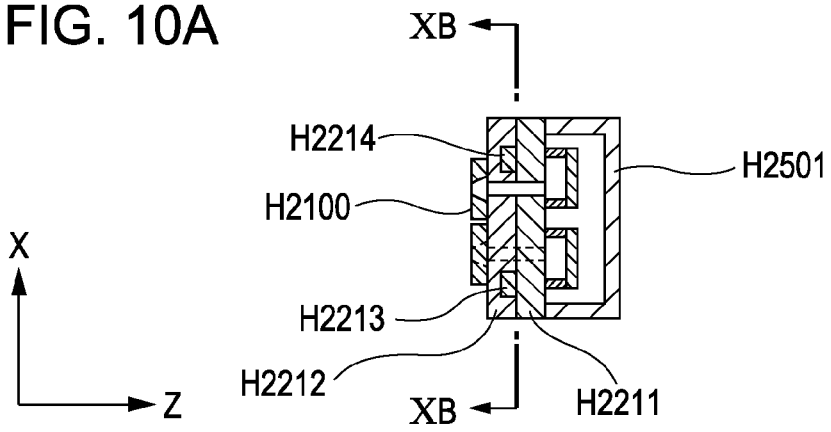
FIG. 10A schematically shows a cross section in the XZ plane of an ink jet recording head of a second embodiment.
Figure 10B:
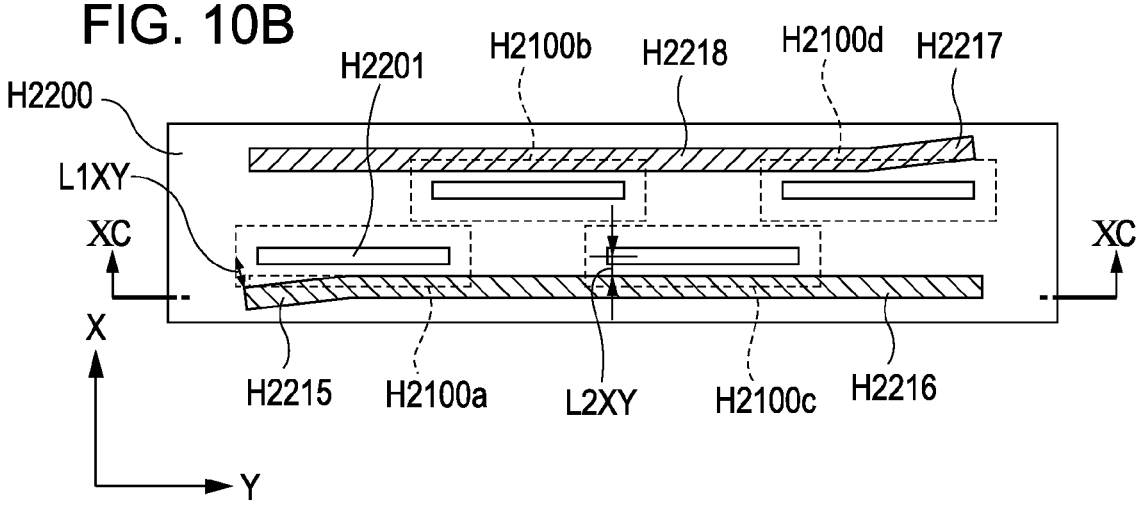
FIG. 10B schematically shows a cross section in the XY plane of an ink jet recording head of a second embodiment.
Figure 10C:
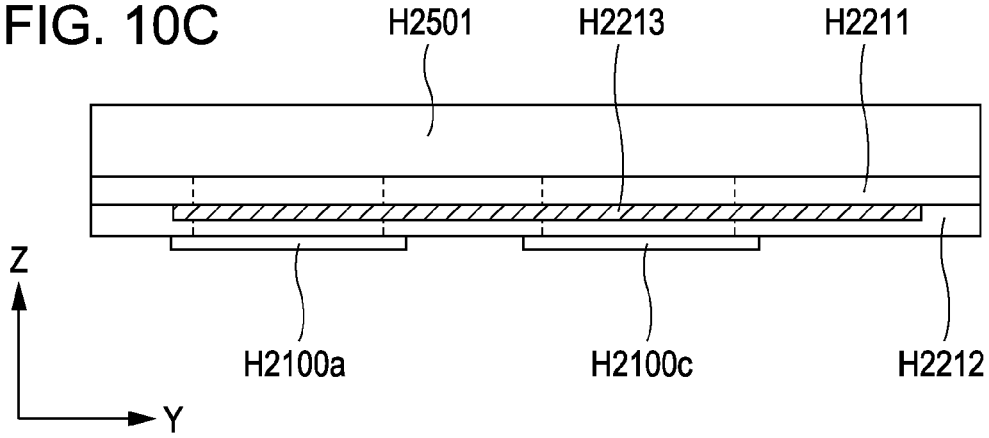
FIG. 10C schematically shows a cross section in the YZ plane of an ink jet recording head of a second embodiment.

FIGS. 10A, 10B, and 10C schematically show partial sections of an ink jet recording head for illustrating another embodiment of the present invention. FIG. 10B is a sectional view taken along line XB-XB of FIG. 10A. FIG. 10C is a sectional view taken along line XC-XC of FIG. 10B.

A support plate H2200 is composed of two members H2211 and H2212. By providing grooves in which coolant flows in the member H2212 and bonding the two members H2211 and H2212 together, coolant flow passages H2213 and H2214 are formed. The inlet and outlet (not shown) of coolant are located on the opposite side of an ink supply member H2500 from recording element substrates H2100. The coolant flow passages are formed so as to be able to independently circulate coolant. The flow passages have a constant cross section that is 2 mm wide and 1.5 mm deep in this embodiment. The flow rate of coolant is about 20 ml/min to 300 ml/min. A flow rate that meets conditions can be set based on the recording conditions and the head specification (the electric power, the amount of discharge, and so forth). A common ink chamber H2501 is provided on the opposite side of the support plate H2200 from the recording element substrates H2100. Through each ink supply port provided in the support plate H2200, ink is supplied to the recording element substrates H2100.

The distance in the Z direction between each recording element substrate H2100 and the nearer coolant flow passage H2213 or H2214 (the distance L1Z, L2Z in the Z direction between each electro-thermal transducer element and the nearer coolant liquid flow passage) is constant (1 mm). The smaller this distance, the larger the cooling effect. The Z direction shows the thickness direction of the recording element substrates or the support plate.

The length in the Y direction of the coolant flow passages H2213 and H2214 is larger than the length in the Y direction of the coolant flow passages H1213 and H1214 of the recording head of the first embodiment and nearly equal to the maximum recording region width. The coolant flow passages H2213 and H2214 are each composed of a parallel portion H2216, H2218 parallel to the Y axis and an angled portion H2215, H2217 at an angle to the Y axis. The distance in the X direction between the angled portion H2215, H2217 and the nearest ink supply port H2201 of the support plate H2200 is largest at the end along the Y direction of the support plate, and gradually decreases toward the middle. That is, as shown in FIG. 10B, the shortest distance L1XY between an electro-thermal transducer element and the nearer coolant flow passage in the XY plane at the end of the support plate along the Y direction is larger than the shortest distance L2XY in the middle of the support plate. As in the first embodiment, L1Z is substantially the same as L2Z. Therefore, if L1XY>L2XY, a relationship L1>L2 is satisfied, where L1 is the shortest distance between an electro-thermal transducer element and the nearer coolant flow passage in the XYZ space at the end of the support plate, and L2 is the shortest distance between an electro-thermal transducer element and the nearer coolant flow passage in the XYZ space in the middle of the support plate.

The coolant in the coolant flow passage H2213 is effective mainly in cooling the recording element substrates H2100*a* and H2100*c*. The coolant in the coolant flow passage H2214 is effective mainly in cooling the recording element substrates H2100*b* and H2100*d*.

Due to such a configuration, the distance between each electro-thermal transducer element of each recording element substrate H2100 and the nearer coolant flow passage H2213 or H2214 is largest at the end along the Y direction of the support plate, gradually decreases toward the middle, and is maintained constant in the middle.

The opposite end of each coolant flow passage H2213, H2214 from the angled portion H2215, H2217 is distant from the nearest recording element substrate H2100 and therefore does not significantly contribute to the cooling of the recording element substrate H2100 and is therefore parallel to the Y axis in the embodiment.

Figure 11:
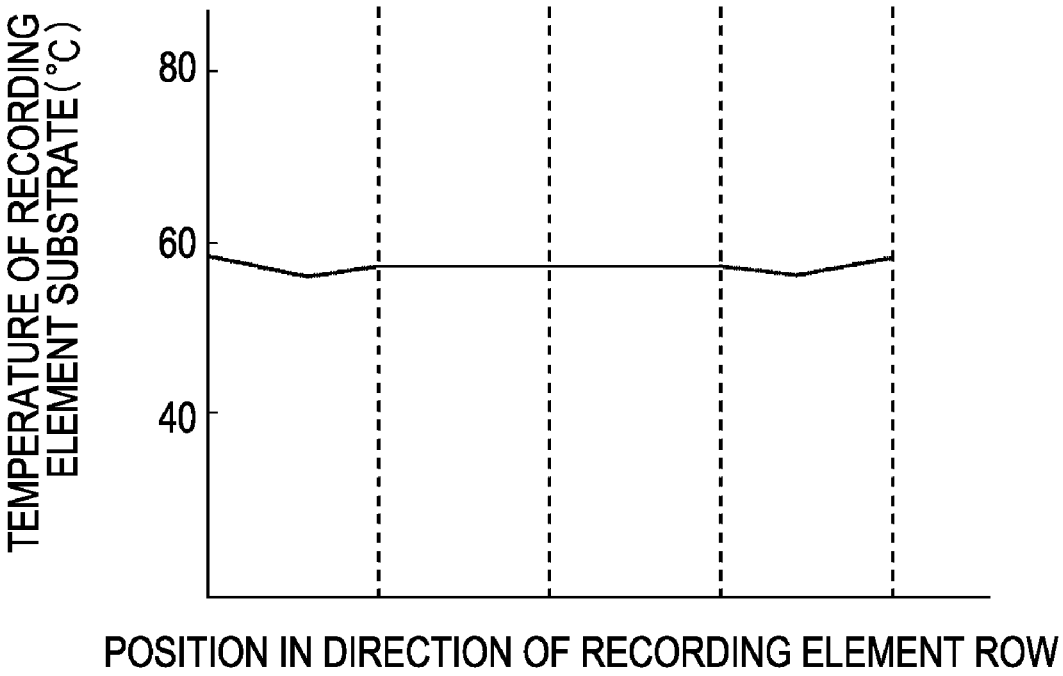
FIG. 11 illustrates the temperature distribution of an ink jet recording head of a second embodiment just after the execution of recording.

FIG. 11 shows the temperature distribution of an ink jet recording head just after the execution of recording in this embodiment. The horizontal axis shows the position in the direction of the recording element arrays (electro-thermal transducer element arrays) of the head. The vertical axis shows the temperature in the vicinity of a discharge port. Disposing one end of each coolant flow passage away from the nearest recording element substrate reduces the cooling effect at both ends of the recording head. The temperature at each end is higher than that in the middle. Therefore, the temperature of the recording head can be substantially evened out throughout the length thereof. Compared to the first embodiment, the cooling effect at each end can be gradually reduced, and therefore a more finely-tuned control of temperature distribution is possible.

The angle and length of the angled portion depends on parameters such as the maximum heating value of the recording element substrates, the distance between each electro-thermal transducer element array and the nearer coolant flow passage, the thermal conductivity of the support plate, and the flow rate of coolant.

Figure 12:
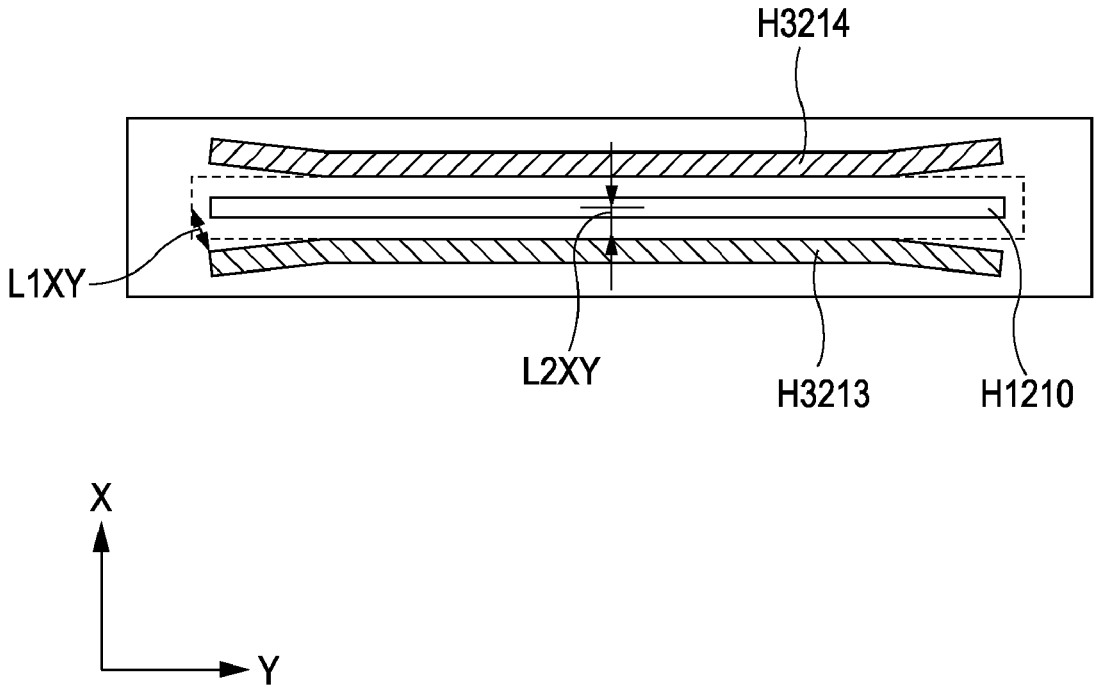
FIG. 12 schematically shows a cross section in the XY plane corresponding to FIG. 10B, of an ink jet recording head using a single elongate recording element substrate.

Although an ink jet recording head in which a plurality of recording element substrates H2100 are arranged in a staggered manner is described above, the present invention can also be applied to an ink jet recording head using a single elongate recording element substrate H2110 as shown in FIG. 12. In this case, in the Y direction, two coolant flow passages H3213 and H3214 are disposed along the electro-thermal transducer element array. Therefore, cooling can be performed from both sides of the recording element substrate by the coolant flow passages. Compared to cooling from one side of the recording element substrate, the cooling effect can be improved. In addition, by providing an angled portion at each end in the Y direction of each of the two coolant flow passages as shown in FIG. 12, a substantially even temperature distribution can be obtained.

Although this embodiment has two coolant flow passages H3213 and H3214, the number of coolant flow passages is not limited to this. Although the coolant flow passages H3213 and H3214 continue throughout the length of the recording head, each of them may be divided in the longitudinal direction.

Third Embodiment

In the second embodiment, the end of each coolant flow passage is disposed away in the X direction from the electro-thermal transducer element array of the nearest recording element substrate.

Figure 13A:
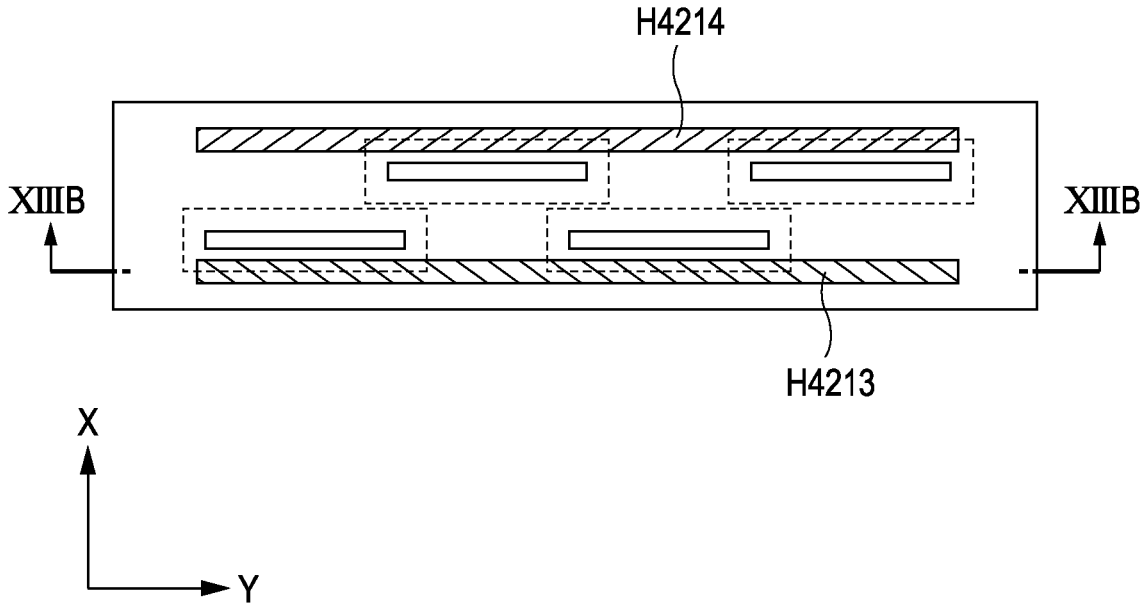
FIG. 13A schematically shows a cross section in the XY plane of an ink jet recording head of a third embodiment.
Figure 13B:
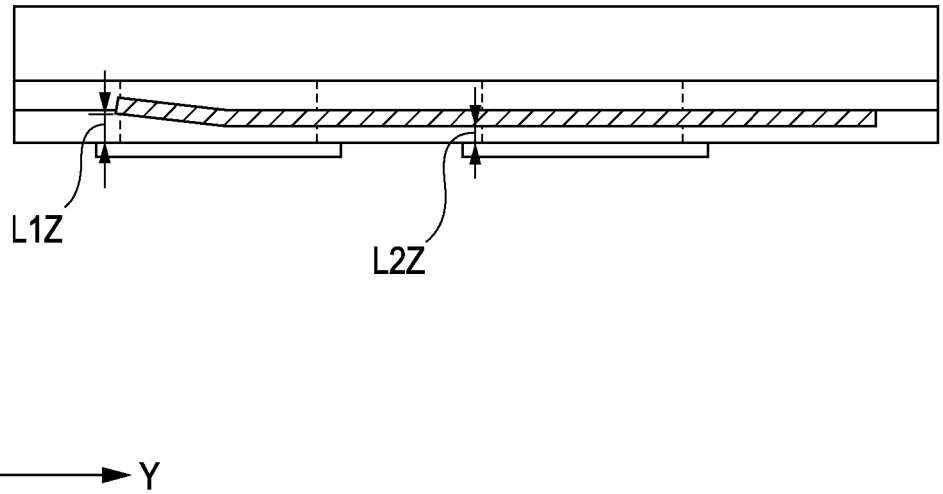
FIG. 13B schematically shows a cross section in the YZ plane of an ink jet recording head of a third embodiment.

A third embodiment is the same as the second embodiment except that one end of each of two coolant flow passages H4213 and H4214 is disposed away from the nearest recording element substrate not in the X direction but in the Z direction as shown in FIGS. 13A and 13B. FIG. 13B is a sectional view taken along line XIIIB-XIIIB of FIG. 13A.

As shown in FIG. 13B, in this embodiment, the shortest distance L1Z between an electro-thermal transducer element and the nearer coolant flow passage in the Z direction at the end of the support plate along the Y direction is larger than the shortest distance L2Z in the Z direction in the middle of the support plate along the Y direction. Also in the case where coolant flow passages are disposed away in the Z direction as in this embodiment, the same advantages as those in the second embodiment can be obtained. Of course, it goes without saying that coolant flow passages may be disposed away both in the X direction and in the Z direction.

Fourth Embodiment

In the second and third embodiments, the end of each coolant flow passage is disposed away from the electro-thermal transducer element array of the nearest recording element substrate with the cross-sectional area of each coolant flow passage maintained constant.

Figure 14:
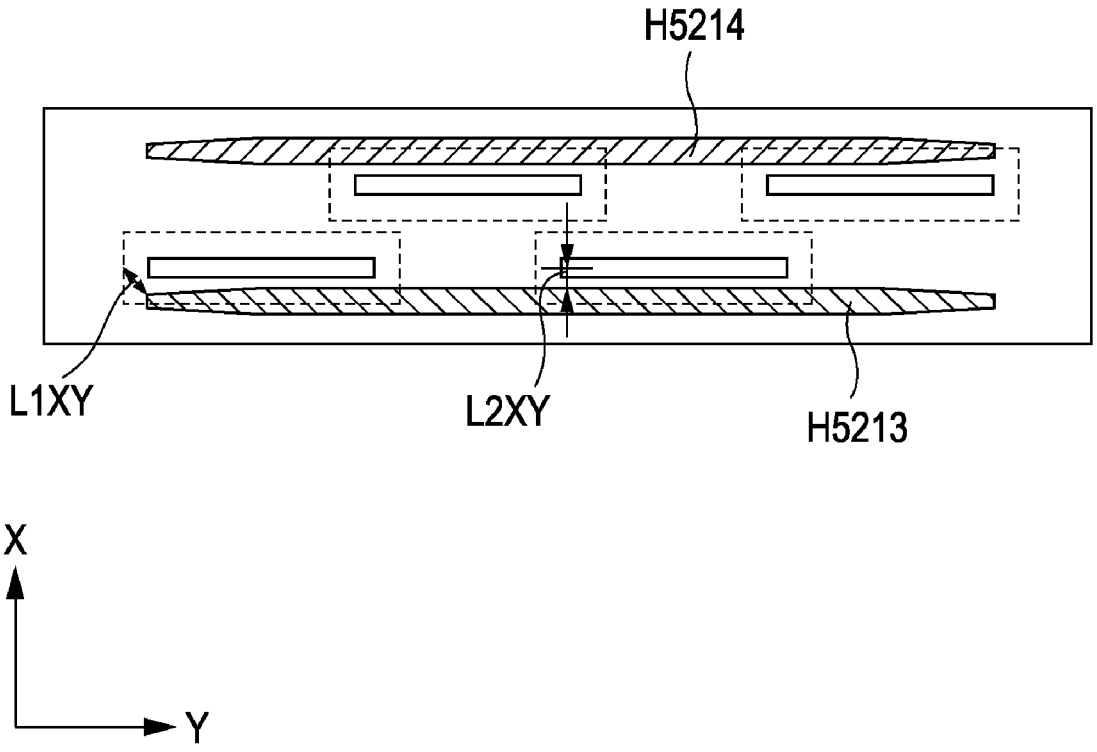
FIG. 14 schematically shows a cross section in the XY plane of an ink jet recording head of a fourth embodiment.

In this embodiment, as shown in FIG. 14, two coolant flow passages H5213 and H5214 are linearly disposed with the cross-sectional area of each coolant flow passage gradually decreasing at the end. Due to such a configuration, the distance L1XY is larger than the distance L2XY. In this case, the reduction in cooling effect due to the reduction in surface area per unit length of each coolant flow passage is added to the reduction in cooling effect due to the increase in distance between each coolant flow passage and the nearest electro-thermal transducer element array. Therefore, the recording head can obtain a substantially even temperature distribution throughout the arranging direction of electro-thermal transducer elements.

Fifth Embodiment

Figure 15A:
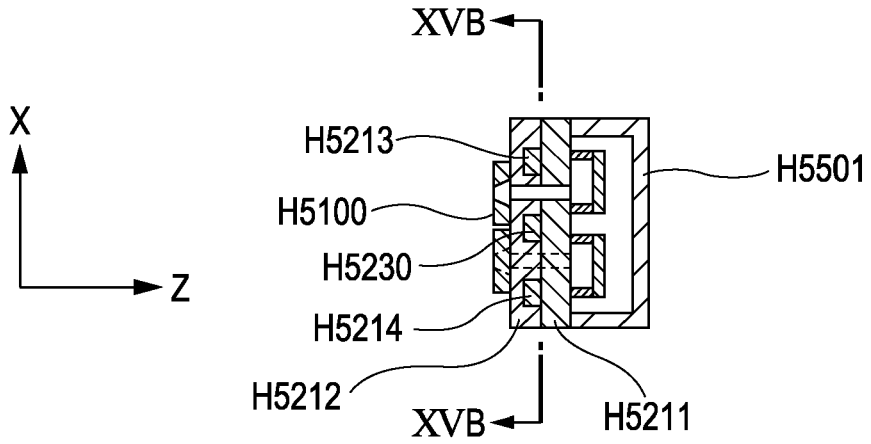
FIG. 15A schematically shows a cross section in the XZ plane of an ink jet recording head of a fifth embodiment.
Figure 15B:
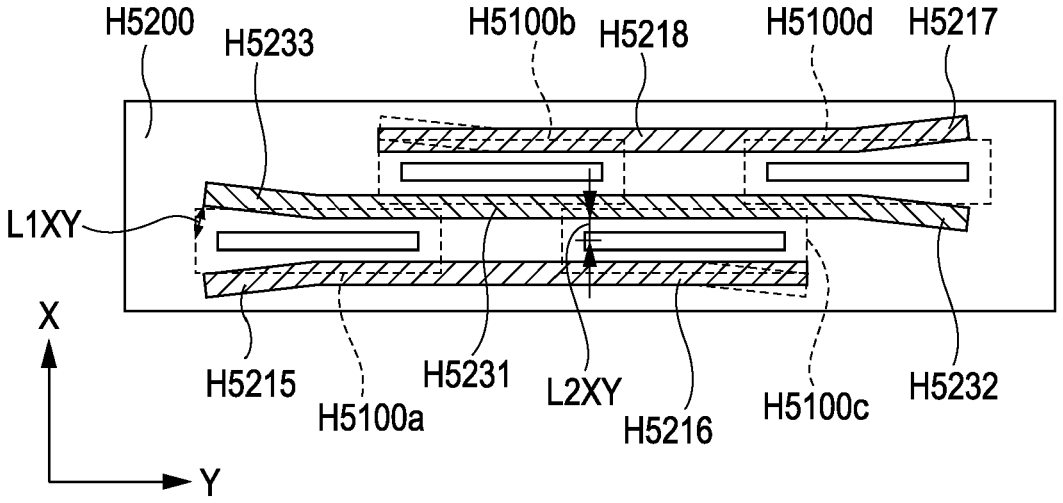
FIG. 15B schematically shows a cross section in the XY plane of an ink jet recording head of a fifth embodiment.

FIGS. 15A and 15B schematically show partial sections of a recording head for illustrating a fifth embodiment of the present invention. FIG. 15B is a sectional view taken along line XVB-XVB of FIG. 15A.

A support plate H5200 is composed of two members H5211 and H5212. A common ink chamber H5501 is provided on the opposite side of the support plate H5200 from the recording element substrates H5100. As in the second embodiment, the coolant flow passages H5213 and 5214 have the angled portions H5217 and H5215, respectively.

In this embodiment, compared to the second embodiment, a coolant flow passage H5230 is added in the center in the X direction of a support plate so as to improve the cooling capability. The coolant flow passage H5230 is composed of a parallel portion H5231 parallel to the Y axis and angled portions H5232 and H5233 at an angle to the Y axis, and cools the center sides of four recording element substrates H5100*a* to H5100*d*.

The regions of the support plate H5200 where a recording element substrate H5100 to be cooled is not disposed need not be provided with a coolant flow passage. That is, coolant flow passages may be provided corresponding only to the parts where the four recording element substrates H5100*a* to H5100*d* are provided. Therefore, the parallel portions H5216 and H5218, which are parallel to the Y axis, of the coolant flow passages H5213 and H5214, respectively, may be shortened to the ends of the recording element substrates H5100*b* and H5100*c*, respectively, as shown in FIG. 15B. The shortened ends of the parallel portions H5216 and H5218 may be angled as shown by dashed line in FIG. 15B.

In such a configuration, the flow direction of coolant of the center coolant flow passage H5230 is preferably opposite to the flow direction of coolant of the outside coolant flow passages H5213 and H5214. That is, the flow directions of coolant flow passages adjacent in the X direction are preferably opposite to each other. As in the first embodiment, the temperature of coolant in each coolant flow passage on the downstream side is higher than that on the upstream side, and therefore a temperature gradient occurs in the coolant in each coolant flow passage along the Y direction. Therefore, when the flow directions are as described above, the temperature gradients are opposite to each other in the Y direction, and therefore a temperature gradient in the whole recording head hardly occurs.

Sixth Embodiment

Figure 16A:
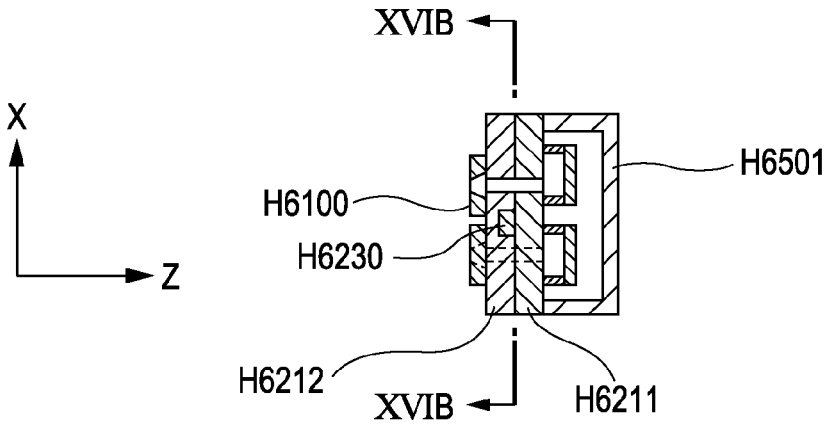
FIG. 16A schematically shows a cross section in the XZ plane of an ink jet recording head of a sixth embodiment.
Figure 16B:
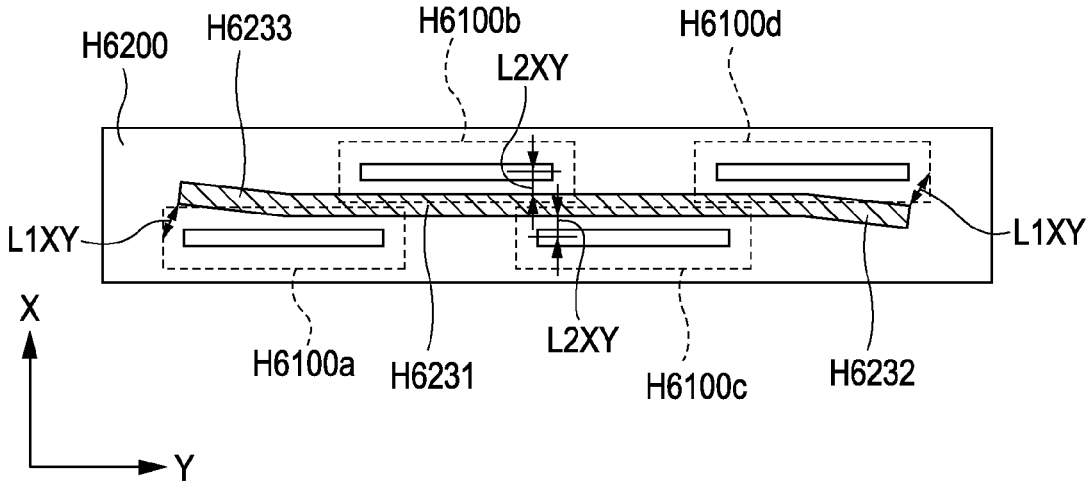
FIG. 16B schematically shows a cross section in the XY plane of an ink jet recording head of a sixth embodiment.

FIGS. 16A and 16B schematically show partial sections of a recording head for illustrating a sixth embodiment of the present invention. FIG. 16B is a sectional view taken along line XVIB-XVIB of FIG. 16A.

A support plate H6200 is composed of two members H6211 and H6212. A common ink chamber H6501 is provided on the opposite side of the support plate H6200 from the recording element substrates H6100 (H6100*a* to H6100*d*).

In this embodiment, a coolant flow passage H6230 is disposed in the center in the X direction of a support plate. The coolant flow passage H6230 is composed of a parallel portion H6231 parallel to the Y axis and angled portions H6232 and H6233 at an angle to the Y axis.

In the XY plane parallel to the main surface of the support plate, the distance between the electro-thermal transducer element array of the recording element substrate H6100*a* and the angled portion H6233 and the distance between the electro-thermal transducer element array of the recording element substrate H6100*d* and the angled portion H6232 increase toward the end of the support plate in the Y direction. Therefore, the cooling effect at each end of the support plate along the Y direction is reduced, and the temperature of the recording head can be substantially evened out throughout the length thereof. In this embodiment, compared to the first to fifth embodiments, the cooling effect on the whole recording head is somewhat smaller but the size of the support plate can be reduced in the X direction. Therefore, the width of the recording head can be reduced in the X direction, and the recording head can be reduced in size.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2007-309699 filed Nov. 30, 2007 and No. 2008-281870 filed Oct. 31, 2008, which are hereby incorporated by reference herein in their entirety.

What is claimed is:

1. An ink jet recording head comprising:

a recording element substrate having a recording element array consisting of a plurality of recording elements configured to generate thermal energy for discharging ink; and a support plate supporting the recording element substrate, the support plate comprising a flow passage through which a liquid for cooling the recording element substrate flows, the flow passage arranged along an arranging direction of the plurality of recording elements, wherein the shortest distance between the flow passage and a recording element arranged closest to an end of the support plate in the arranging direction among the plurality of recording elements is larger than the shortest distance between the flow passage and a recording element arranged closest to a middle of the support plate in the arranging direction among the plurality of recording elements.

2. The ink jet recording head according to claim 1, wherein a plurality of the recording element substrates is arranged so that the recording element array continues along the arranging direction.

3. The ink jet recording head according to claim 2, wherein the plurality of recording element substrates is arranged in a staggered manner.

4. The ink jet recording head according to claim 1, wherein the shortest distance between the recording element and the flow passage decreases from the end toward the middle of the support plate in the arranging direction.

5. The ink jet recording head according to claim 1, wherein the support plate has a supply port configured to supply ink to the recording element substrate and at least two of the flow passages, the supply port being disposed between the at least two of the flow passages in a direction parallel to a main surface of the support plate and perpendicular to the arranging direction.

6. The ink jet recording head according to claim 1, wherein the support plate has at least two supply ports supplying ink to the recording element substrate, the flow passage being disposed between the at least two supply ports in a direction parallel to a main surface of the support plate and perpendicular to the arranging direction.

7. An ink jet recording apparatus comprising:

the ink jet recording head according to claim 1; and a supplying unit supplying liquid that flows through the flow passage.

8. The ink jet recording head according to claim 1, wherein the shortest distance between the flow passage and the recording element arranged closest to the end of the support plate in the arranging direction among the plurality of recording elements and the shortest distance between the flow passage and the recording element arranged closest to the middle of the support plate in the arranging direction among the plurality of recording elements are distances in a direction along a main surface of the support plate.

9. The ink jet recording head according to claim 1, wherein the shortest distance between the flow passage and the recording element arranged closest to the end of the support plate in the arranging direction among the plurality of recording elements and the shortest distance between the flow passage and the recording element arranged closest to the middle of the support plate in the arranging direction among the plurality of recording elements are distances in a direction along a thickness direction of the support plate.

10. The ink jet recording head according to claim 1, wherein the flow path is shorter than the recording element array in the arranging direction.

11. The ink jet recording head according to claim 1, wherein the support plate is composed of a plurality of plates.

12. An ink jet recording head comprising:

a recording element array consisting of a plurality of recording elements configured to generate thermal energy for discharging ink; and a flow passage through which a liquid for cooling the recording element array flows, the flow passage arranged along an arranging direction of the plurality of recording elements, wherein a shortest distance between the flow passage and the recording element at an end of the recording element array is larger than a shortest distance between the flow passage and the recording element in a middle of the recording element array.

13. The ink jet recording head according to claim 12, wherein a plurality of the recording element substrates having the plurality of recording elements are arranged so that the recording element array continues along the arranging direction.

14. The ink jet recording head according to claim 13, wherein the plurality of recording element substrates are arranged in a staggered manner.

* * * * *